US005737935A

United States Patent [19]

Heo

[11] Patent Number: 5,737,935

[45] Date of Patent: Apr. 14, 1998

[54] APPARATUS FOR INTENSIVELY COOLING FOOD NEWLY LOADED IN A REFRIGERATOR

[75] Inventor: Kyung Kil Heo, Kyungsangnam-Do, Rep. of Korea

[73] Assignee: LG Electronics, Inc., Seoul, Rep. of Korea

[21] Appl. No.: 721,905

[22] Filed: Sep. 27, 1996

[51] Int. Cl.[6] ..... F25D 17/04

[52] U.S. Cl. ..... 62/186; 62/408; 62/440

[58] Field of Search ..... 454/285, 153; 62/407, 408, 409, 440, 186, 452, 404

[56] References Cited

U.S. PATENT DOCUMENTS

| | | | |
|---|---|---|---|
| 4,276,754 | 7/1981 | Ty | 62/187 |
| 4,534,279 | 8/1985 | Cardiff | 454/285 |
| 5,072,657 | 12/1991 | Sakai | 454/285 |
| 5,490,395 | 2/1996 | Williams et al. | 62/187 |

FOREIGN PATENT DOCUMENTS 2193566 2/1988 United Kingdom .

*Primary Examiner*—John M. Sollecito

*Attorney, Agent, or Firm*—Ostrolenk, Faber, Gerb & Soffen, LLP

[57] ABSTRACT

A new load intensive-cooling apparatus of a refrigerator includes a base plate fixed in an upper portion of the rear wall of a cooling compartment and having a vent in the middle thereof, a plurality of vanes pivoted on the base plate to thereby direct cooling air, a slide lever for moving the vanes left and right, a motor for horizontally moving the slide lever, a limit switch provided adjacent to an end of the slide lever for controlling the motor, a cover having a plurality of slots therein for passing the cooling air, and a pair of temperature sensors fixed on the side walls of the cooling compartment for detecting a temperature variation in the cooling compartment. The apparatus enables cooling a newly loaded food rapidly and intensively as well as preventing the temperature of the cooling compartment from being raised. Further, it serves to reduce electric power consumption.

5 Claims, 9 Drawing Sheets

FIG. 11A
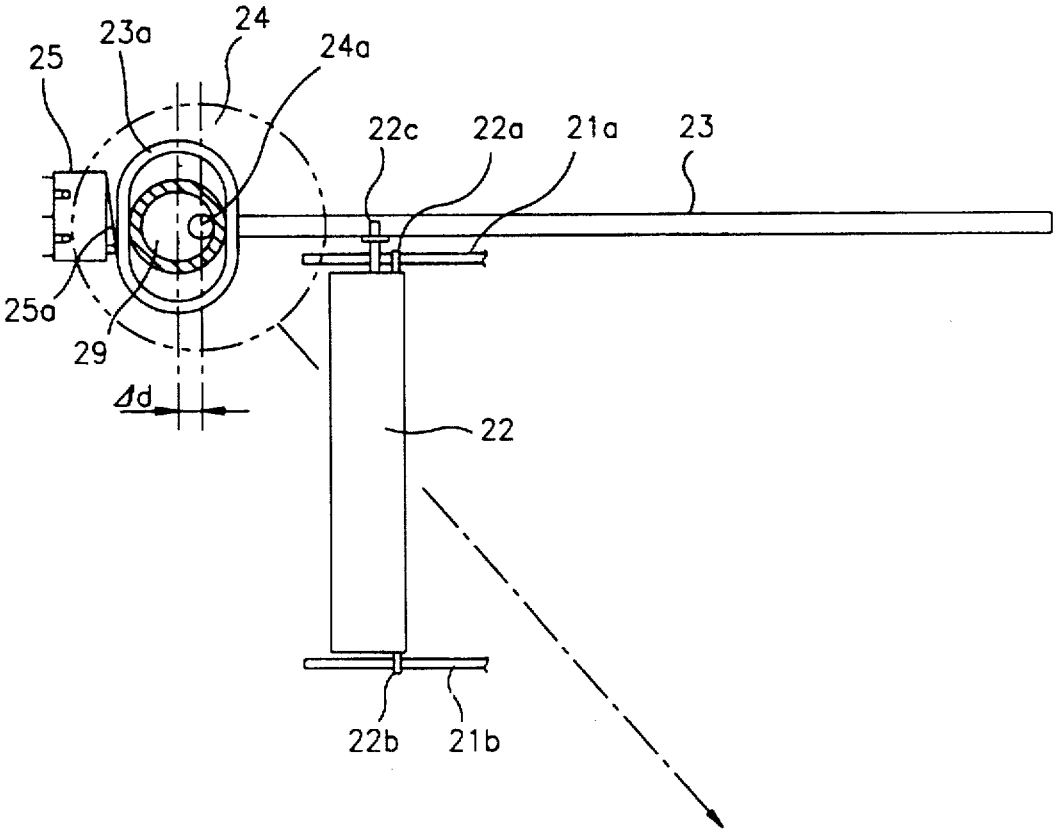
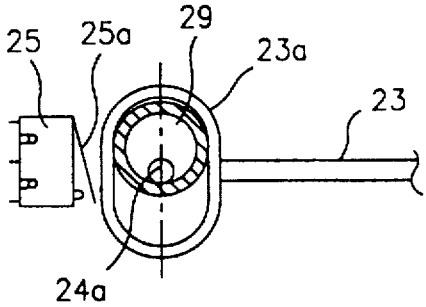
FIG. 11B

APPARATUS FOR INTENSIVELY COOLING FOOD NEWLY LOADED IN A REFRIGERATOR

BACKGROUND OF THE INVENTION

1. Field of the Invention

The present invention relates to a cooling apparatus, and more particularly to a new load intensive-cooling apparatus for a refrigerator which makes it possible to cool a newly loaded food rapidly and intensively while preventing the temperature in the cooling compartment from being raised, as well as reducing electric power consumption.

2. Description of the Prior Art

As shown in FIGS. 1 and 2, a conventional refrigerator includes an outer shell 1 and an inner shell 2 between which there is filled an insulating material 3. Between an upper freezing compartment 4 and a lower cooling compartment 5 there is provided a barrier 6 serving as an inner insulation. Sequentially from the back of the freezing compartment 4, there are provided a shroud 7 having a plurality of holes 7*a* therethrough and a grill panel 8 having a plurality of holes 8*a* therethrough for conducting cooling air therethrough. A refrigeration chamber 9 is formed behind to the left of the shroud 7 as shown in FIG. 2.

In the refrigeration chamber 9 there are provided a fan 10 driven by a motor 11 and an evaporator 12. Inside the barrier 6 there are formed first and second conduits 6*a*, 6*b* for respectively feeding back to the refrigeration chamber 9 the cold air circulated in the corresponding ones of the freezing and cooling compartments 4, 5. Also, a third conduit 6*c* is formed in a portion of the barrier 6 for sending cooling air generated in the refrigeration chamber 9 to the cooling compartment 5.

A damper 13 is provided in the rear of the cooling compartment 5 for supplying the cooling compartment 5 with the cooling air applied thereto from the evaporator 12 of the refrigeration chamber 9, in which damper 13 there are formed a plurality of holes 13*a* spaced from each other by a certain distance.

A plurality of shelves 14 are detachably provided in the cooling compartment 5 for receiving food to be refrigerated. A vegetable box 15 is provided in a lower portion of the cooling compartment 5.

The thusly composed conventional refrigerator is operated as follows.

Some of the cooling air generated by the fan 10 powered by the motor 11 through the evaporator 12 is sent through each of the holes 7*a* in the shroud 7 and the holes 8*a* in the grill panel 8 into the freezing compartment 4. The cooling air circulated in the freezing compartment 4 is then flowed through the first conduit 6*a* formed in the barrier 6 to the evaporator 12 in the refrigeration chamber 9.

The rest of the cooling air from the evaporator 12 is transferred sequentially through the third conduit 6*c* of the barrier 6 and the plurality of holes 13*a* in the damper 13 into the cooling compartment 5, and cools food loaded on the shelves 14 and in the vegetable box 15, and then is fed back to the refrigeration chamber 9 through the second conduit 6*b*.

However, the above-described conventional refrigerator has a disadvantage in that a temperature rise may occur in the cooling compartment due to food newly loaded on the shelves and/or in the vegetable box which may result in a deterioration of the food stored previously therein, and the increase in air-cooling time necessitated by the newly loaded food may lead to an increased electric power consumption.

SUMMARY OF THE INVENTION

Accordingly, it is an object of the present invention to provide a new load intensive-cooling apparatus for a refrigerator capable of cooling a newly loaded food rapidly and intensively while preventing the temperature in the cooling compartment from being raised, as well as reducing electric power consumption.

To achieve the above-described object, the new load intensive-cooling apparatus of a refrigerator having a cooling compartment provided with side walls and a rear wall to which cooling air is supplied includes a base plate fixed in an upper portion of the rear wall of the cooling compartment and having a vent opening in a middle thereof, a plurality of vanes pivotably mounted to the base plate to thereby direct cooling air from the vent opening, a slide lever connected to the plurality of vanes for pivoting the vanes to the left and right, a motor for horizontally moving the slide lever, a limit switch provided adjacent to an end of the slide lever for controlling operation of the motor, a cover having a plurality of slots therein for passing the cooling air and being mounted to the base plate, and a pair of temperature sensors fixed on each side wall of the cooling compartment for detecting a temperature variation in the cooling compartment.

BRIEF DESCRIPTION OF THE DRAWINGS

FIG. 11 provides partial front views showing the operation of a synchronous motor of the apparatus according to the present invention.

DETAILED DESCRIPTION OF THE PRESENT INVENTION

Figure 1:
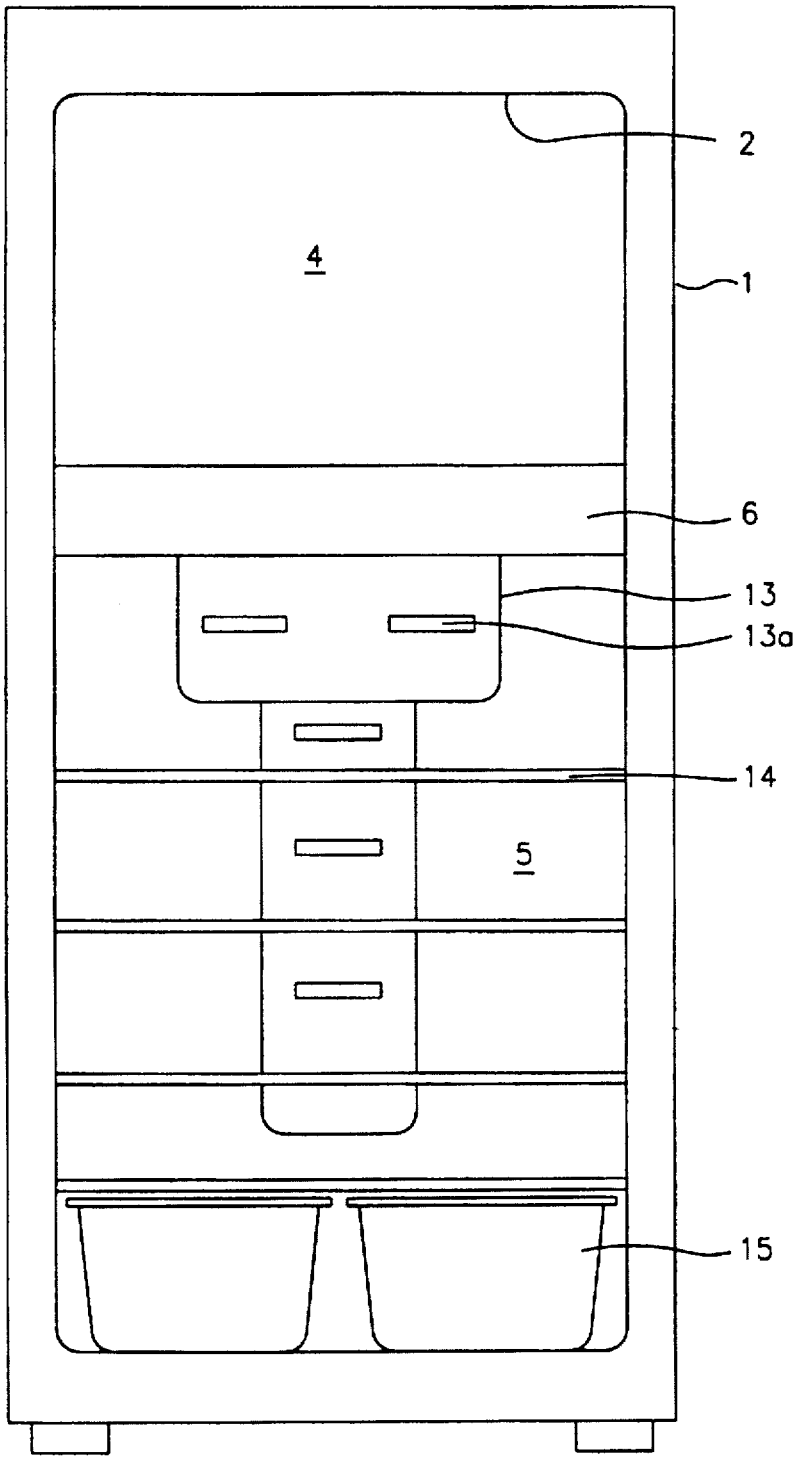
FIG. 1 CONVENTIONAL ART
FIG. 1 is a front view of a conventional refrigerator.
Figure 2:
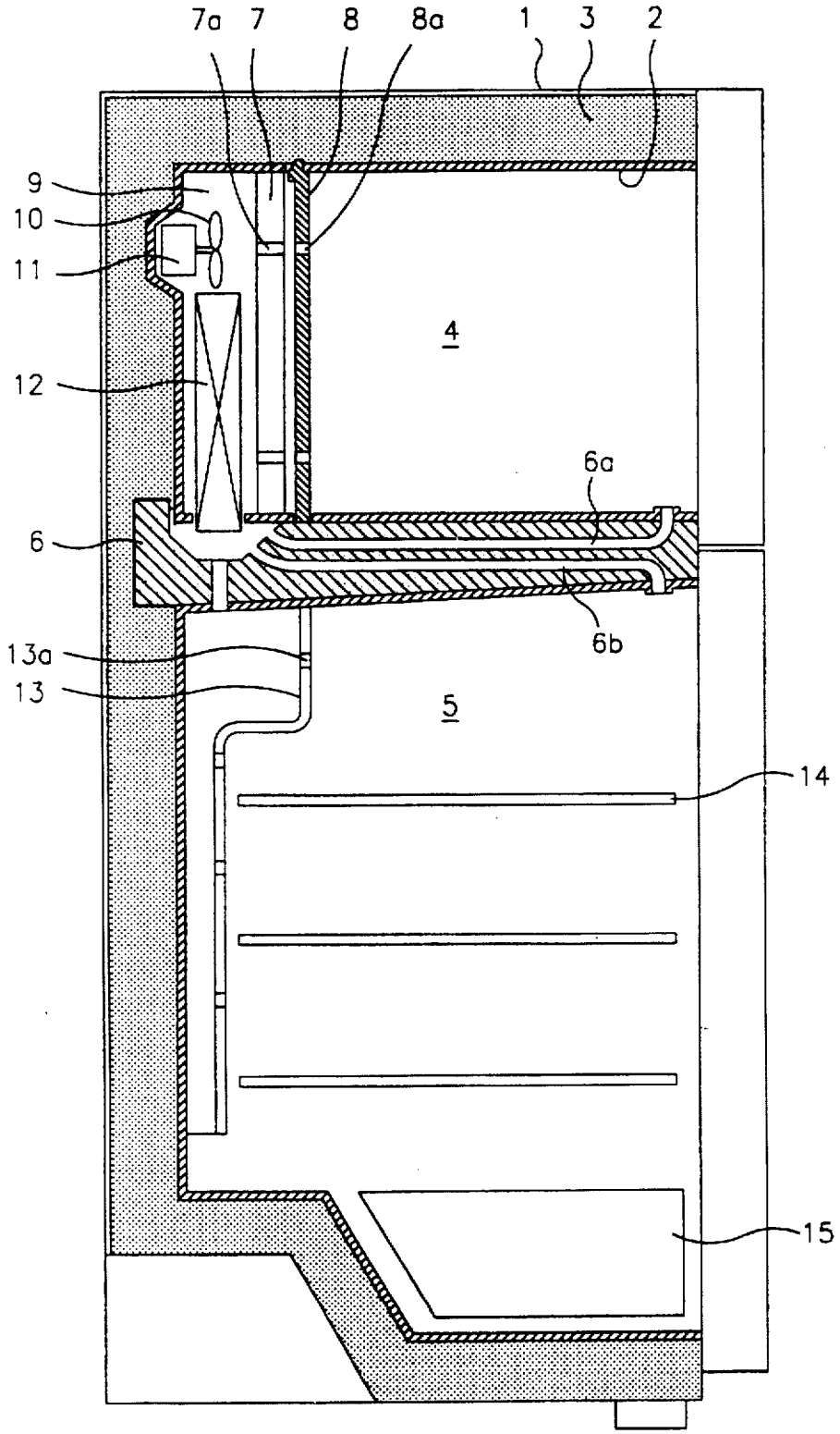
FIG. 2 CONVENTIONAL ART
FIG. 2 is a cross-sectional side view of the conventional refrigerator.
Figure 3:
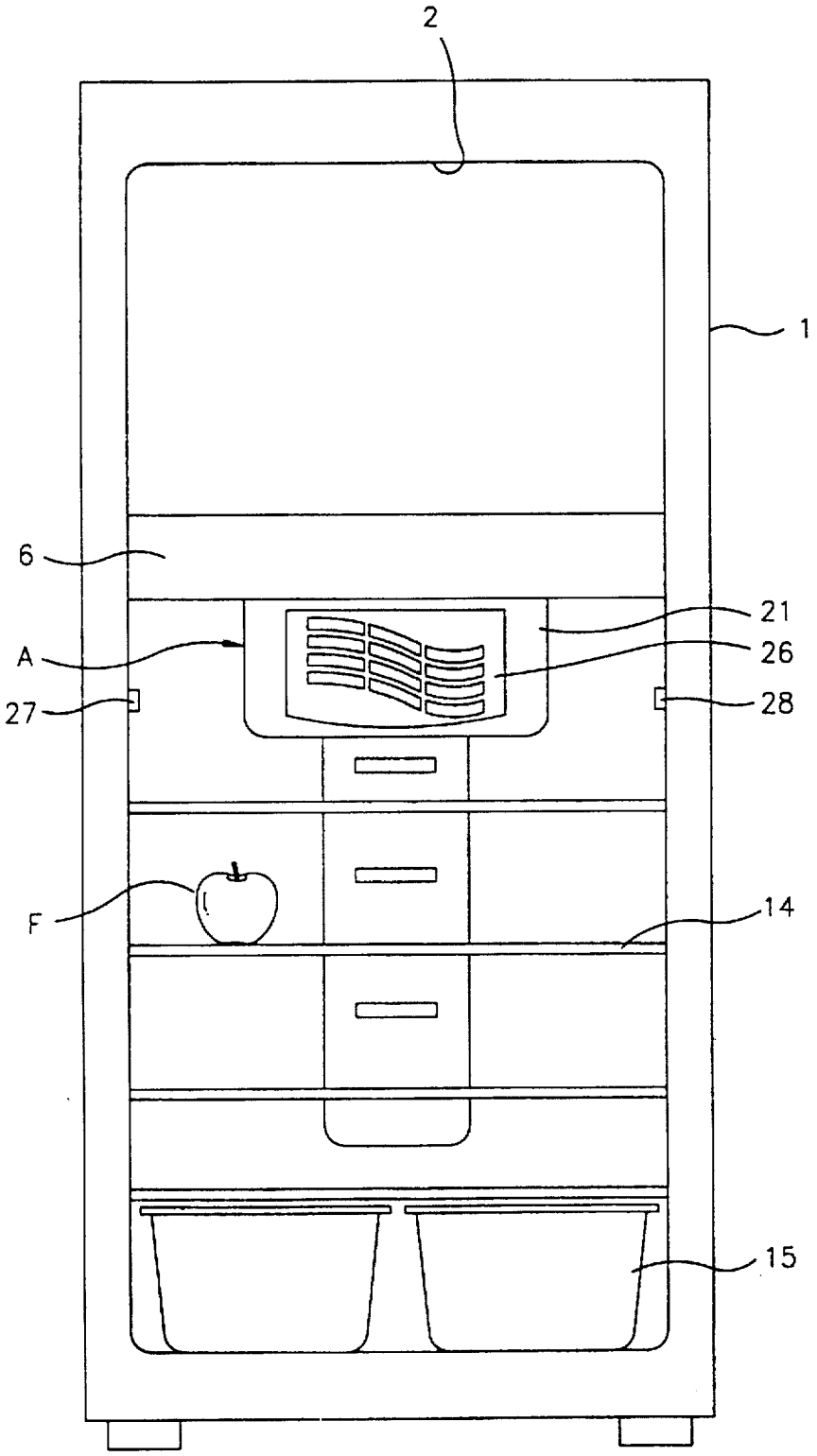
FIG. 3 is a front view showing a refrigerator adopting the new load intensive-cooling apparatus according to the present invention.
Figure 4:
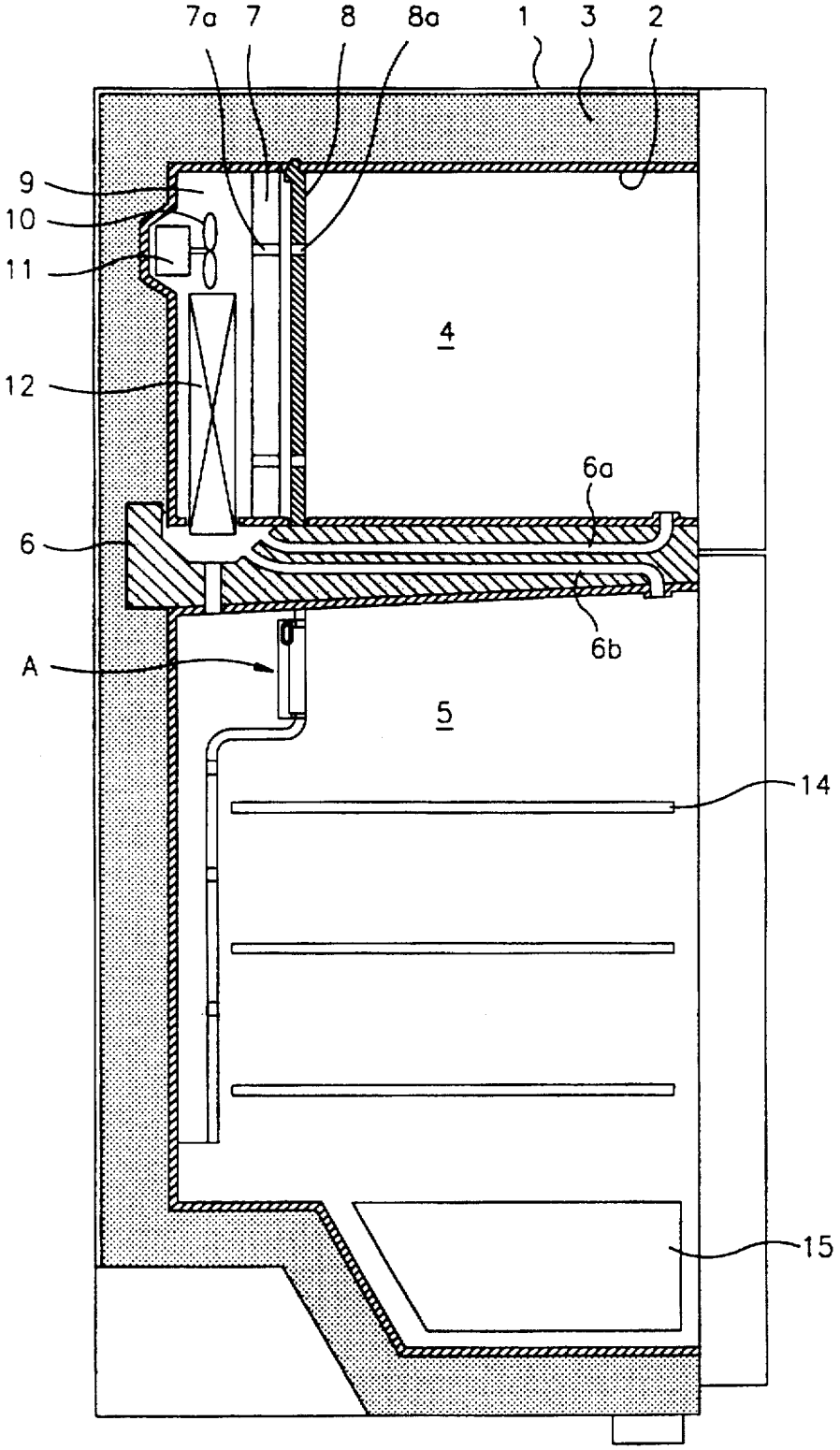
FIG. 4 is a cross-sectional side view showing the refrigerator adopting the load intensive-cooling apparatus according to the present invention.
Figure 5:
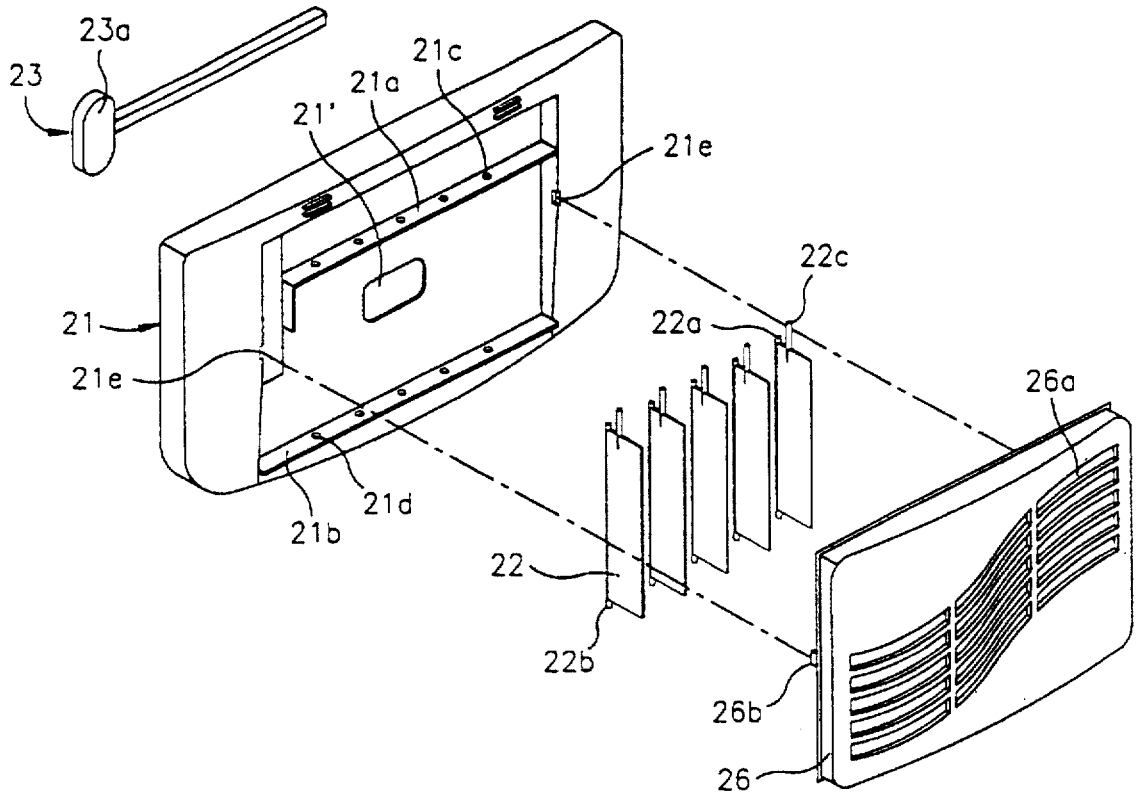
FIG. 5 is an exploded perspective view showing each part of the new load intensive-cooling apparatus for a refrigerator according to the present invention.
Figure 6:
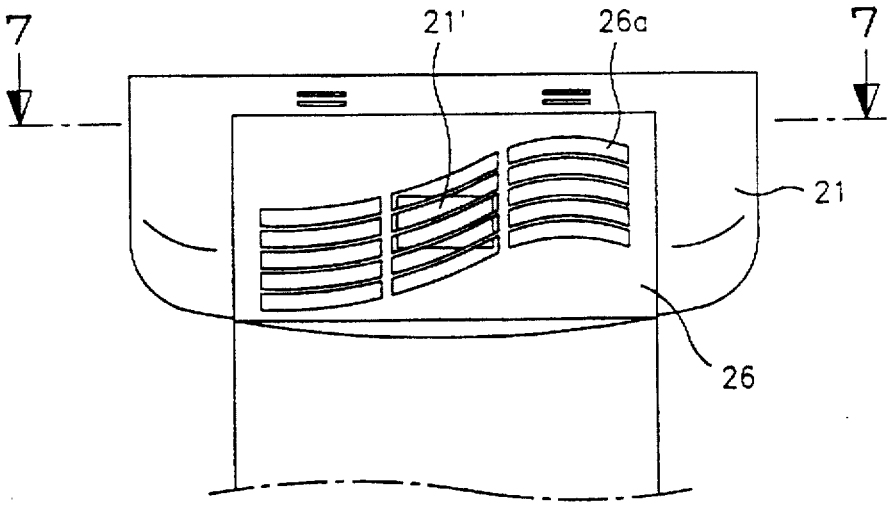
FIG. 6 is a front view of the assembled apparatus of FIG. 5.
Figure 7:
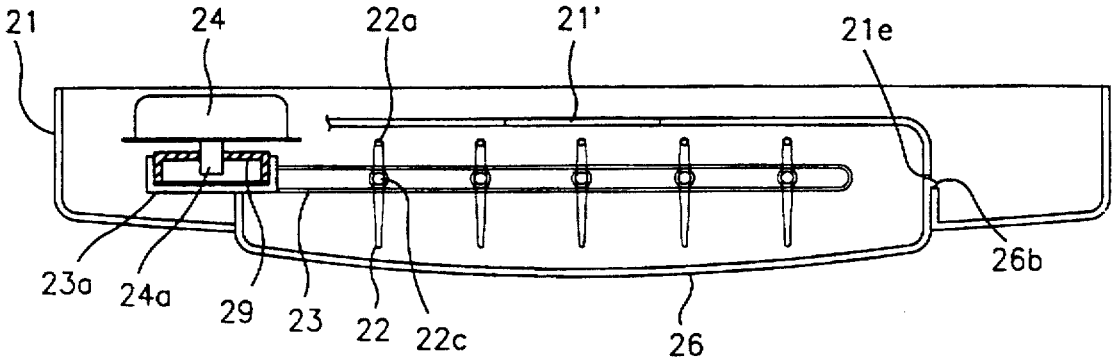
FIG. 7 is a cross-sectional view taken along the line B—B in FIG. 6.
Figure 8:
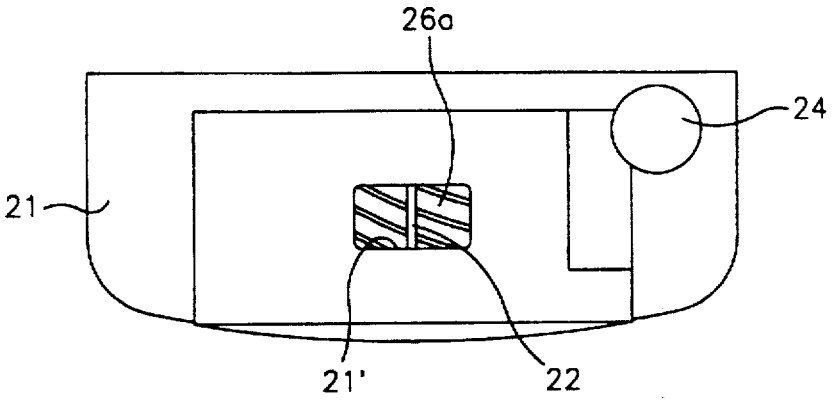
FIG. 8 is a rear view of the assembled apparatus FIG. 6.

As shown in FIGS. 3 and 4, the new load intensive-cooling apparatus A for a refrigerator in accordance with the present invention is provided at an upper portion of a rear wall in the cooling department 5.

With reference to FIGS. 3 through 8, the new load intensive-cooling apparatus includes: a base plate 21 having a vent opening 21' in the middle thereof and being fixed in an upper portion of the rear wall of the cooling compartment 5; a plurality of vanes 22 pivotably mounted in the base plate 21 for directing cooling air from the vent opening 21'; a slide lever 23 carried on the base plate 21 and movable to the left and right and connected to an upper portion of each of the vanes 22 at a lower surface thereof; a synchronous motor 24 mounted at a corner inside the base plate 21 and having an eccentric shaft 24*a* thereon for horizontally moving the slide lever 23; a limit switch 25 provided adjacent to the synchronous motor 24 for controlling the operation thereof; a cover 26 having a plurality of slots 26*a* therein for passing the cooling air therethrough; and a pair of temperature sensors 27, 28 fixed on the respective side walls of the cooling compartment 5 for detecting a temperature variation therein.

A pair of horizontal supports 21*a*, 21*b* are respectively provided on an upper and lower portion of a recessed front surface of the base plate 21 for supporting the vanes 22, in each of which supports 21*a*, 21*b* there are formed a plurality of hinge holes 21*c*, 21*d* spaced from each other by a certain distance.

A pair of hinge pins 22*a*, 22*b* serving as a hinge axis are provided respectively on the upper and lower ends of each of the vanes 22 and inserted into a corresponding pair of the hinge holes 21*c*, 21*d* for pivotal rotation therein.

In the lower surface of the slide lever 23 there is provided a plurality of spaced holes in each of which is inserted a corresponding connection shaft 22*c* extended from the top center of each of the vanes 22 which is pivoted on its hinge pins 22*a*, 22*b* in accordance with the horizontal movement of the slide lever 23, thereby controlling the direction of the cooling air.

As shown in FIG. 11, at an end portion of the slide lever 23 there is provided an elliptical member 23*a*. There is provided on a motor shaft 24*a* of the motor 24 an eccentric cam 29 having a certain eccentric diameter Δd. The cam 29 is inserted inside the elliptical member 23*a* whereby the slide lever 23 is moved to the left and right according to the rotation of the motor shaft 24*a*. Also, a lever 25*a* of the limit switch 25 is contacted by the elliptical member 23*a* upon the leftward movement of the slide lever 23, so as to stop the motor 24 for thereby restraining rotation of the vanes 22.

A hook 26*b* is formed on each edge portion of the cover 26 to be hooked into a corresponding hook opening 21*e* of the base plate 21, for thereby fixing the cover 26 to the base plate 21.

The operation of the new load intensive-cooling apparatus according to the present invention will now be described.

When a new load (food) F is stored in the cooling compartment 5, the pair of temperature sensors 27, 28 begin to sense the temperature variation in the cooling compartment 5.

The sensor 27 on the left wall of the cooling compartment 5 senses the initially higher temperature of the new load F provided on the left side of the shelf 14 as shown in FIG. 3 and accordingly the cool air from the evaporator 12 is intensively supplied to the new load F, thereby preventing the other food stored previously therein from being affected by the higher temperature of the new load F and accordingly reducing electric power consumption.

Figure 9A:
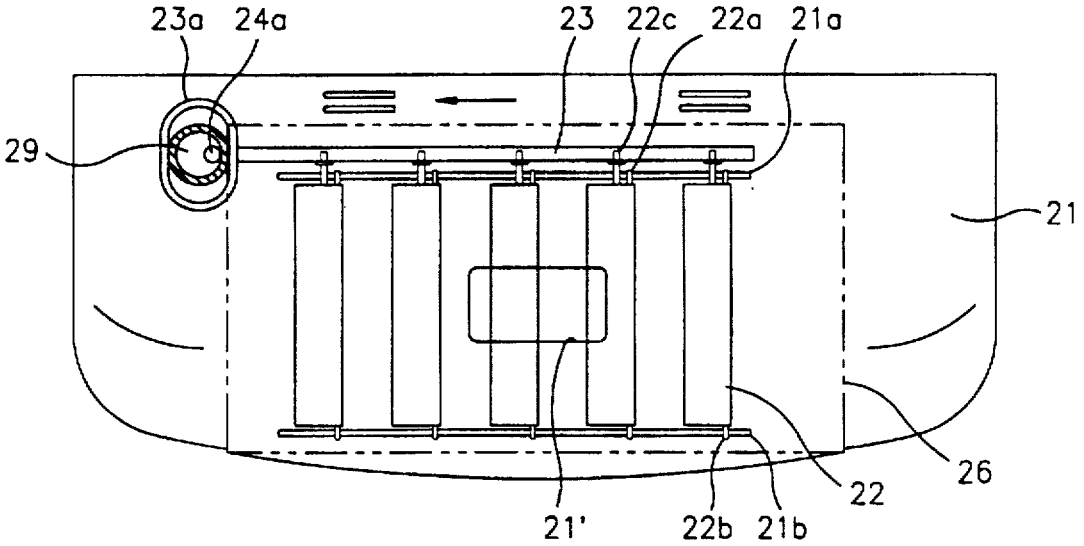
FIGS. 9A and 9B are front views showing the operation of the load intensive-cooling apparatus of the present invention.
Figure 10A:
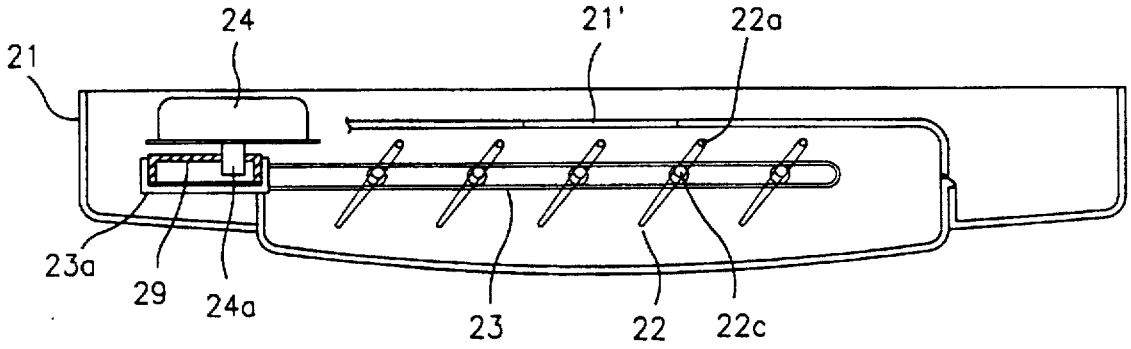
FIGS. 10A and 10B are cross-sectional views respectively taken along the lines C—C and D—D in FIGS. 9A and 9B.

More specifically, the temperature of the new load F is detected by the sensor 27, and an electrical signal is in turn applied to the synchronous motor 24 to cause the motor shaft 24*a* to be rotated clockwise as shown in FIG. 9A, thereby moving the slide lever 23 to the left as shown in FIG. 10A. As a result, the vanes 22 connected to the slide lever 23 are oriented to face the new load F.

At this time, the elliptical member 23*a* extended from the slide lever 23 is abutted to the limit switch lever 25*a* for thereby actuating the limit switch 25, which serves to stop the operation of the synchronous motor 24. As a result, the cooling directing vanes 22 maintain their present position and are not further pivoted.

That is, when the temperature sensor 27 detects a higher temperature due to the new load F, the motor 24 is operated to cause the slide lever 23 to be moved so as to move the vanes 22 for directing the cooling air towards the new load F until the switch lever 25*a* of the limit switch 25 is abutted by the elliptical member 23*a* of the slide lever 23 and until the vanes 22 are stopped moving at a certain position so as to direct the cooling air toward the new load F. Thereafter, the cycling time of the slide lever 23 is sensed by a ready-set timer and the resultant value serves to stop the operation of the synchronous motor 24.

Consequently, in the state in which the plurality of vanes 22 are directed to the new load F, the cooling air generated by the evaporator 12 passes through the third conduit 6C in the barrier 6 and passes through the vent opening 21' and then is guided to the new load F by the vanes 22, thereby cooling the new load F rapidly and intensively while preventing the temperature in the cooling compartment 5 from being raised.

Figure 9B:
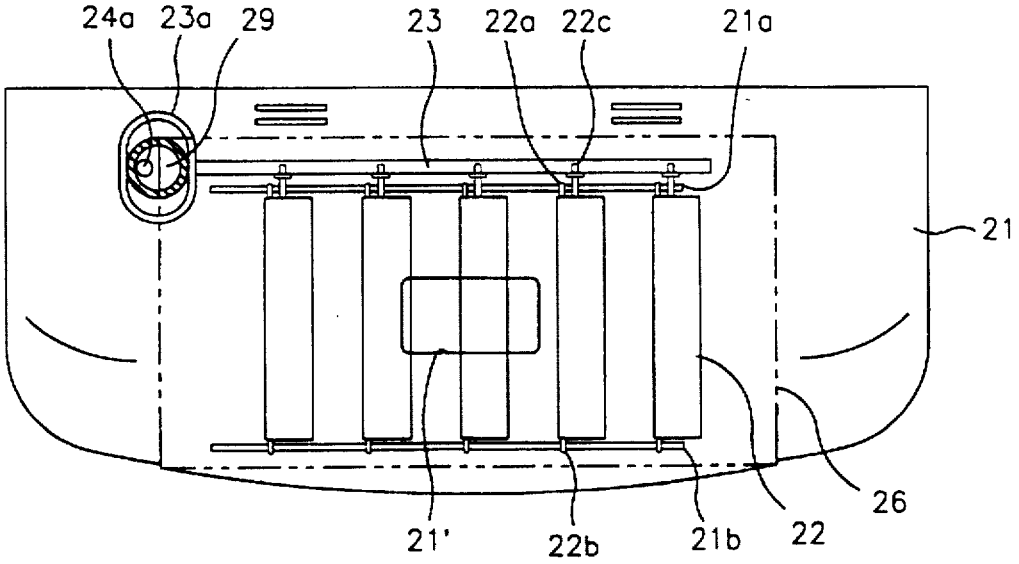
Figure 10B:
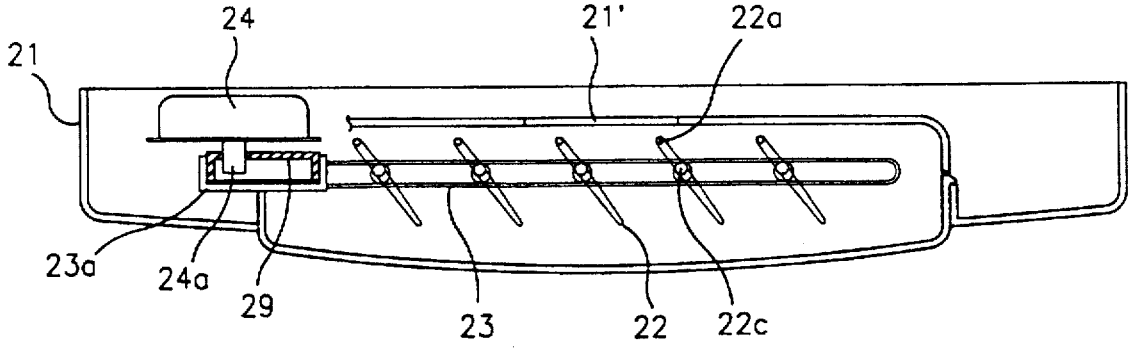

As shown in FIGS. 9B and 10B, when positioned on the right side of the shelf 14, the new load F is intensively cooled by rotating the motor 24 clockwise to move the lever 23 and vanes 22 to the right.

When the temperature in the cooling compartment 5 is lowered by the intensive cooling directed to the new load F, the synchronous motor 24 is operated to cause the slide levee 23 to make a reciprocating linear shuttle movement, so that the vanes 22 are pivoted to the left and right (oscillated) for evenly distributing the cooling air throughout the cooling compartment 5.

As described above, the new load intensive-cooling apparatus for a refrigerator in accordance with the present invention is capable of cooling a newly loaded food rapidly and intensively as well as preventing the temperature of other food in the cooling compartment from being raised.

Further, the intensive cooling apparatus serves to reduce electric power consumption.

What is claimed is:

1. An apparatus for directing cooling air toward food newly loaded in a refrigerator having a cooling compartment provided with side walls and a rear wall through which the cooling air is supplied, comprising:

a base plate fixed in an upper portion of the rear wall of the cooling compartment and having a vent opening in a middle thereof;

a plurality of vanes pivotably mounted to the base plate to thereby direct cooling air from the vent opening;

a slide lever connected to the plurality of vanes for pivoting the vanes to the left and right;

a motor for horizontally moving the slide lever;

a limit switch provided adjacent to an end of the slide lever for controlling operation of the motor;

a cover having a plurality of slots therein for passing the cooling air and being mounted to the base plate; and a pair of temperature sensors fixed on said side walls of the cooling compartment for detecting a temperature variation at one side relative to another side in the cooling compartment caused by food newly loaded therein, the temperature sensors being effective to cause the motor to orient the vanes to direct the cooling air toward the newly loaded food.

2. The apparatus as recited in claim 1, further comprising a pair of horizontal support respectively provided on an upper and lower portion of a recessed front surface of the base plate for pivotably mounting each of the vanes.

3. The apparatus as recited in claim 2, wherein a plurality of hinge holes spaced from each other are formed in each of the horizontal support.

4. The apparatus as recited in claim 1, wherein a connection pin extended from a top center of each of the vanes is connected in a lower surface of the slide lever.

5. The apparatus as recited in claim 1, wherein at an end portion of the slide lever there is provided an elliptical member inside which there is an eccentric cam driven by a motor shaft extended from the motor for thereby enabling the slide lever to make a linear shuttle movement according to the rotation of the eccentric cam by the motor.

* * * * *

UNITED STATES PATENT AND TRADEMARK OFFICE

CERTIFICATE OF CORRECTION

PATENT : 5,737,935

DATED : Apr. 14, 1998

INVENTOR(S) : Heo

It is certified that error appears in the above-identified patent and that said Letters Patent is hereby corrected as shown below:

On the title page, insert -- [30] Foreign Application Priority Data
October 13, 1995 [KR] REPUBLIC OF KOREA .....95-35387--.

Signed and Sealed this

Ninth Day of March, 1999

*Attest:*

*Attesting Officer*

Q. TODD DICKINSON

*Acting Commissioner of Patents and Trademarks*